US005775248A

United States Patent [19]

Simola

[11] Patent Number: 5,775,248

[45] Date of Patent: Jul. 7, 1998

[54] STABILIZED FLOAT DRUM

[76] Inventor: Charles H. Simola, P.O. Box 147, Speculator, N.Y. 12164

[21] Appl. No.: 770,947

[22] Filed: Dec. 18, 1996

[51] Int. Cl.[6] ..... B63B 35/44

[52] U.S. Cl. ..... 114/267; 114/263

[58] Field of Search ..... 114/125, 121, 114/123, 263, 266, 267, 68, 69, 357; 405/219

[56] References Cited

U.S. PATENT DOCUMENTS

| | | | |
|---|---|---|---|
| 2,858,790 | 11/1958 | Russell, Jr. | 114/267 |
| 3,323,479 | 6/1967 | Filak | 114/266 |
| 3,522,618 | 8/1970 | Stranzinger | 114/266 |
| 4,974,538 | 12/1990 | Meriwether | 114/267 |
| 5,125,355 | 6/1992 | Stranzinger | 114/266 |
| 5,347,948 | 9/1994 | Rytand | 114/263 |
| 5,460,114 | 10/1995 | McMillan | 114/266 |

FOREIGN PATENT DOCUMENTS

| | | | |
|---|---|---|---|
| 2680749 | 3/1993 | France | 114/266 |
| 404163290 | 6/1992 | Japan | 114/267 |

*Primary Examiner*—Ed L. Swinehart
*Attorney, Agent, or Firm*—Robert O. Wright

[57] ABSTRACT

A stabilized float drum is shown having interlocking side and end walls and an upper compartment filled with a flotation medium such as closed cell foam and a lower member with a selected number and size of holes in the surfaces thereof to admit water which then acts as a stabilizing force when the float is subjected to upsetting wave action or eccentric loads. The degree of stabilization or damping is controlled by the relative size of the lower member and the size, placement and number of holes.

18 Claims, 5 Drawing Sheets

STABILIZED FLOAT DRUM

This invention relates to buoyant float drums for use in marine structures and more particularly to a stabilized float drum and floating dock construction that resists tipping under eccentric loads.

BACKGROUND OF INVENTION

For many years floating docks have been constructed utilizing sealed containers of air such as barrels and more recently blocks of foam such as styrofoam. Because of damage to and from wildlife, foam floats now generally consist of blocks of closed cell foam encapsulated within a plastic skin or covering to provide the desired flotation. Such air or foam blocks have been economical and easy to use as modular blocks in dock building but have generally resulted in relatively unstable platforms particularly when several people attempt to stand along one edge of an elongated dock. The tipping or tilting of the dock, especially narrower ones has been a persistent problem.

One attempt to solve this problem in a floating dock is shown in U.S. Pat. No. 5,347,948 to Rytand. Rytand shows spaced apart longitudinal beams or stringers forming elongated chambers in which he places foam blocks so as to fill the upper two thirds of the chamber. The lower one third of the chambers are allow to fill with water by seepage when the dock is installed. The water tends to act as ballast. The longitudinal beams tend to limit longitudinal deflection and the ballast tends to limit lateral tipping. This construction however is cumbersome to make and handle, especially out of the water, and is limited in the sizes and shapes that can be easily and economically made.

OBJECTS AND BRIEF DESCRIPTION

Accordingly it is an object of the present invention to provide a buoyant float drum and dock construction that overcomes the limitations of the prior art.

It is another object of the present invention to provide a buoyant float drum and dock construction that results in greatly improved stability.

It is another object of the present invention to provide a buoyant float drum, utilizing a block of closed cell foam, and having improved stability.

It is a further object of the present invention to provide a stabilized buoyant float drum and floating dock using same that resists tipping and tilting due to eccentric loads and wave action.

It is a still further object of the present invention to provide a modular stabilized float drum that can be made in high volume economical production for easy assembly on site into a stable floating dock structure.

A still further object of the present invention is to provide a stabilized float drum that utilizes the water in which it is to be floated as ballast to stabilize the float without requiring additional compensating flotation.

Still another object of the invention is to provide a means of stabilizing a float drum that can easily be matched to both the frequency and amplitude of unbalancing forces acting thereon.

These and other and further objects of the invention are accomplished in one embodiment of the invention by a buoyant float drum having an upper compartment filled with a closed cell foam and a lower compartment empty but with a number of holes of preselected size formed in the surfaces of the lower compartment to provide water access to and from the compartment.

DESCRIPTION OF PREFERRED EMBODIMENT

Figure 1:
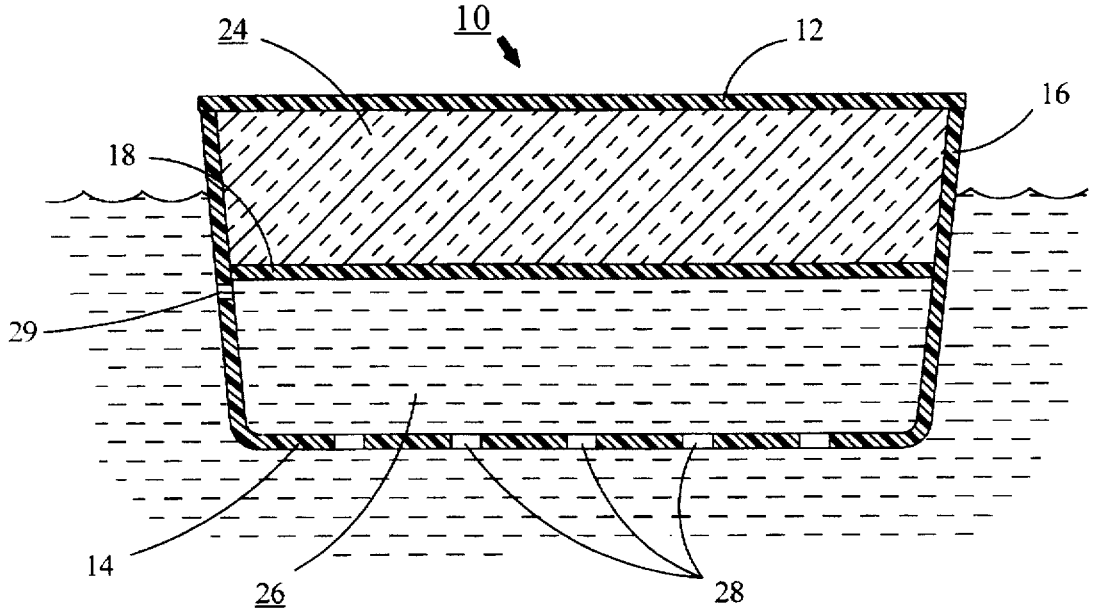
FIG. 1 is a cross sectional view of a float drum taken on line 1—1 of FIG. 2.

Referring now to FIG. 1 there is shown in cross section a float drum 10 according to the present invention. As may be seen in FIGS. 1–3 drum 10 is in the form of a rectangular box having top 12, bottom 14, side and end walls 16, and a partition 18. Partition 18 divides drum 10 into an upper compartment 20 and a lower compartment 22. Upper compartment 20 is filled with a floatation medium. This may be air or preferably a closed cell EPS foam 24. Lower compartment 22 is filled with water 26 from the body of water in which the drum is floated. One or more holes 28 are formed in the bottom or sides of the lower compartment to admit water 26 when the drum is placed in a body of water and to restrict discharge therefrom.

Drum 10 is preferably made from a moldable plastic such as polyethylene, polyvinylchloride, or other suitable material generally impervious to fresh and/or salt water. Foam 24 may be a polyurethane, polystyrene or other suitable closed cell foam that will not take on significant amounts of water. The foam 24 is completely enclosed within compartment 20 to inhibit attack by wild life and to meet Army Corp of Engineers Specifications.

Holes 28 are chosen both in size, number, and placement to restrict water access and movement to provide the desired amount of damping of movement of float 10 and any dock structure formed therewith. By proper selection various types of upsetting forces such as wave action, wind forces, and eccentric deck loads can be greatly reduced. Also the relative size of the two compartments is chosen to meet specific upsetting conditions as well as load carrying requirements.

Figure 2:
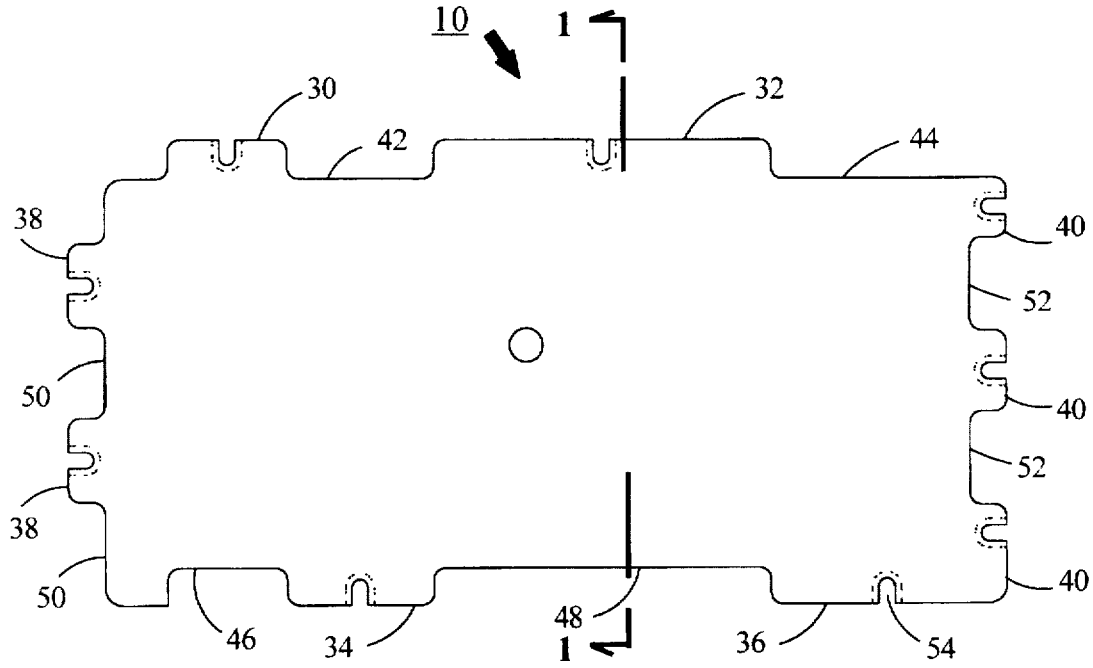
FIG. 2 is a top plan view of the float of FIG. 1.
Figure 7:
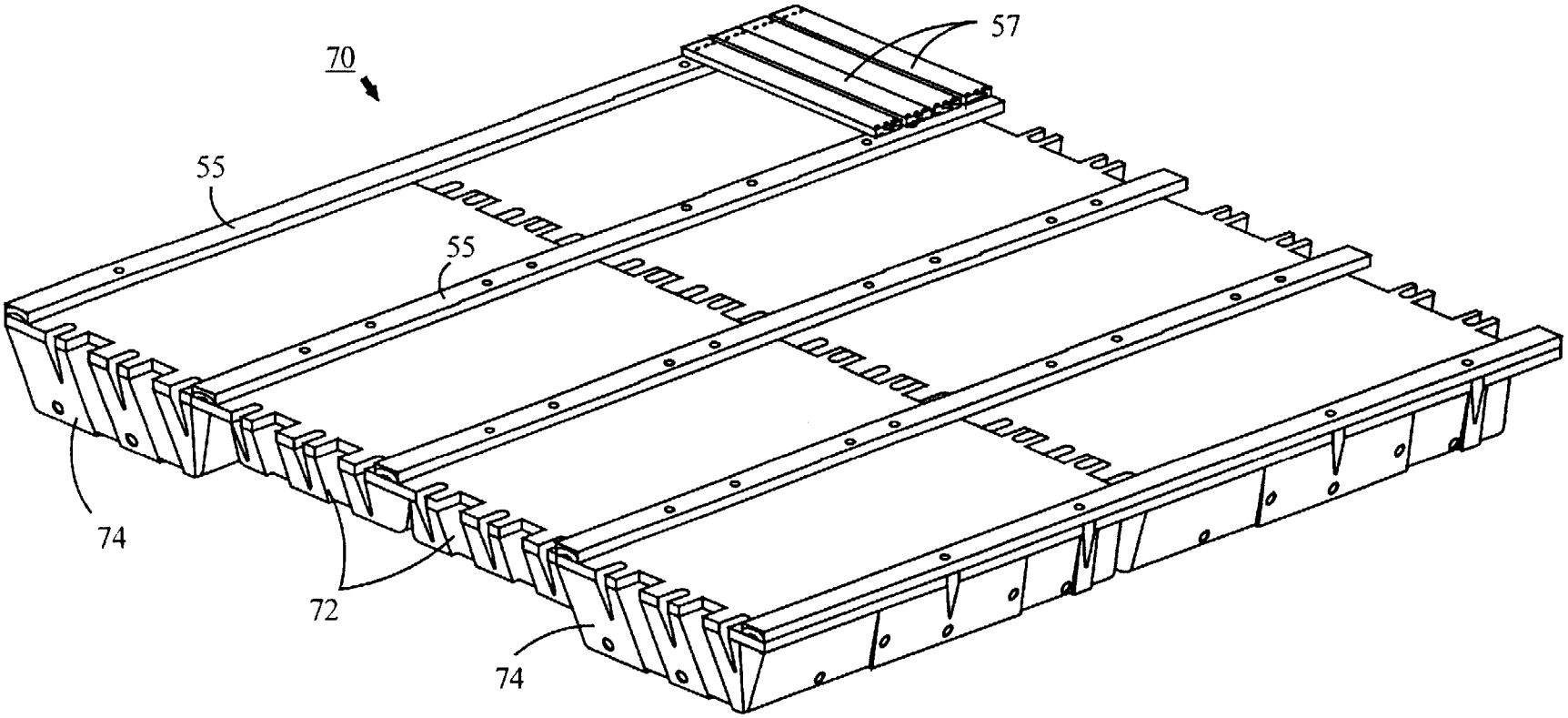
FIG. 7 is a perspective view of the float drum of FIG. 1 installed in a floating dock construction

As shown in FIG. 2, a series of lugs or flanges 30–40 are provided which extend outwardly from the top edge of drum 10 and form recesses 42–52. The lugs and recesses are positioned so that when two or more float drums are positioned side by side or end to end the upper edges interlock to form a continuous upper surface for a floating dock or the like. As shown in FIG. 7, lug 34 will fit in recess 42, lug 36 in recess 44, lugs 38 in recesses 52, and lugs 40 in recesses 50. Slots 54 are provided in the various lugs through which bolts or screws (not shown) may be inserted to secure the drums 10 to the framework of a marine structure, such as stringers 55. Stringers 55 will extend longitudinally along the length of the dock and the floats 10 on either side are secured thereto from underneath. Thus a single stringer may be shared by two rows of float drums in constructing a dock instead of each row of drums requiring its own stringers to join them into a dock structure. A dock surface 57 is then mounted on the top of the stringers 55. Surface 57 may be planks, plywood or metal fastened to the top of the stringers 55.

Float drums 10 are molded with their outer wall surfaces extending out to the edges of the flanges and recesses so that when interlocked at the flanges not only is a flat upper surface formed but also the corresponding adjacent wall lugs and recesses interlock with minimal taper clearances to form an almost solid dock structure. A superior dock structure results even with float drums without stabilizing compartments as may be seen in the two inner rows of drums in FIG. 7.

Figure 3:
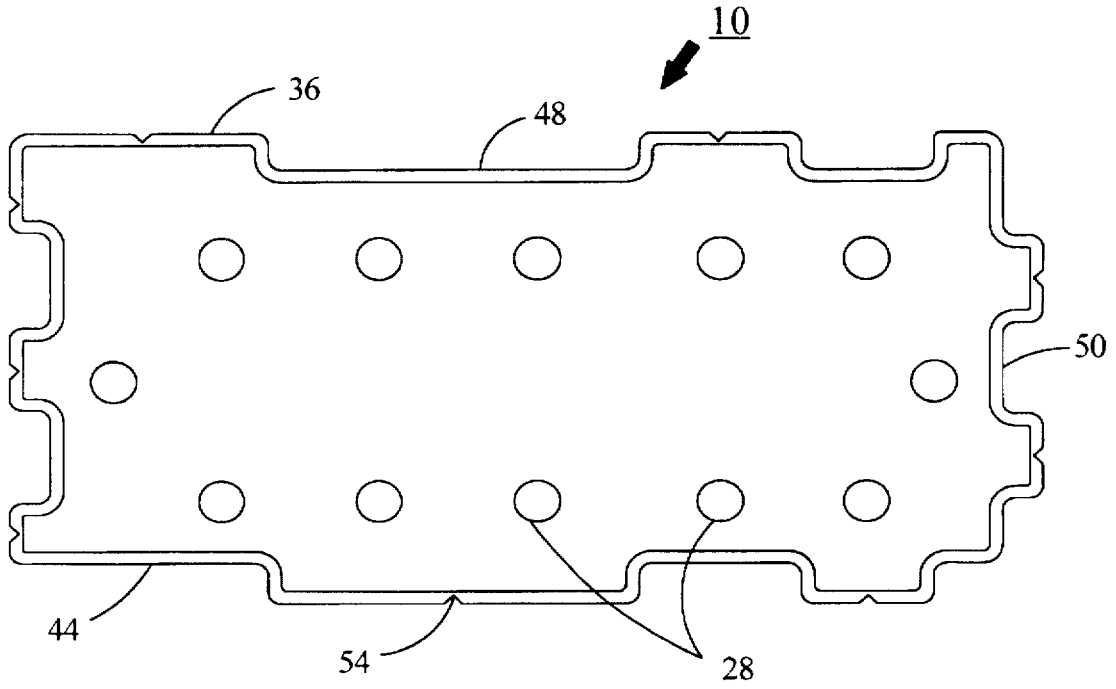
FIG. 3 is a bottom plan view of the float of FIG. 1.

Holes 28 may be seen in FIG. 3 spaced around the periphery of the drum 10 and the size and number are chosen to provide the desired damping effect by controlling the time it takes for water captured in the lower space 26 to flow out of and into said space as the drum is moved up and down in the body of water in which it is floating. Upon initial placement of the drum 10 in a body of water it will slowly sink to the equilibrium depth shown in FIG. 1 for a particular load condition. Vertical and lateral displacement of drum 10 will be resisted by the water in compartment 26 proportional to the number, placement and sizes of holes 28. In order for float 10 to assume its designed position in the water small weep holes 29 may be provided adjacent the upper wall of the lower compartment to permit any trapped air to escape.

While I have shown the upper compartment 20 filled with closed cell foam 24 the compartment 20 can be sealed containing air only and equivalent floatation achieved. In some constructions the principal function of the foam is to stiffen and structurally reinforce the walls of compartment 20. In this construction the foam also serves as a backup flotation in the event of a leak in the upper compartment. In an air only float the walls usually are thicker and internal stiffeners are provided.

Figure 4:
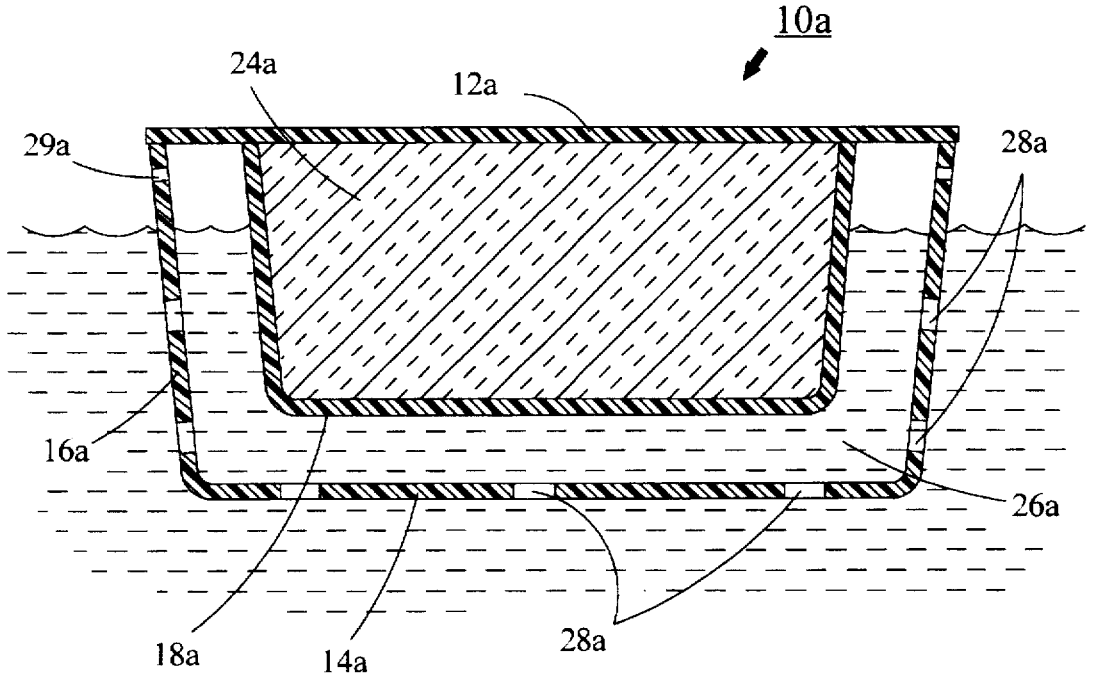
FIG. 4 is a view similar to FIG. 1 of another embodiment of the present invention.

Referring now to FIG. 4, there is shown another embodiment of the present invention. Here drum 10*a* is formed with the upper compartment 24*a* centered within the outer walls. Partition 18*a* forms a sealed internal flotation chamber within float drum 10*a*, suspended under top 12*a*. Holes 28*a* may be positioned in the bottom 14*a* and the sidewalls 16*a* as desired along with weep holes 29*a* just below the top 12*a* as needed. The added height of the water column within drum 10*a* will for some situations result in additional stabilization.

It should be noted that the horizontal bottom and vertical sides of the second compartment in at least some applications form resistance plates to unwanted momentary movement of the float drum and thus stabilize the float drum in the water. The baffles of the embodiment shown in FIGS. 5 & 6 perform a similar function for at least vertical displacement of the float drum in water. In both embodiments the second compartment and the baffles are substantially neutral buoyancy, neither adding to nor subtracting from the buoyancy of the float drum.

Figure 5:
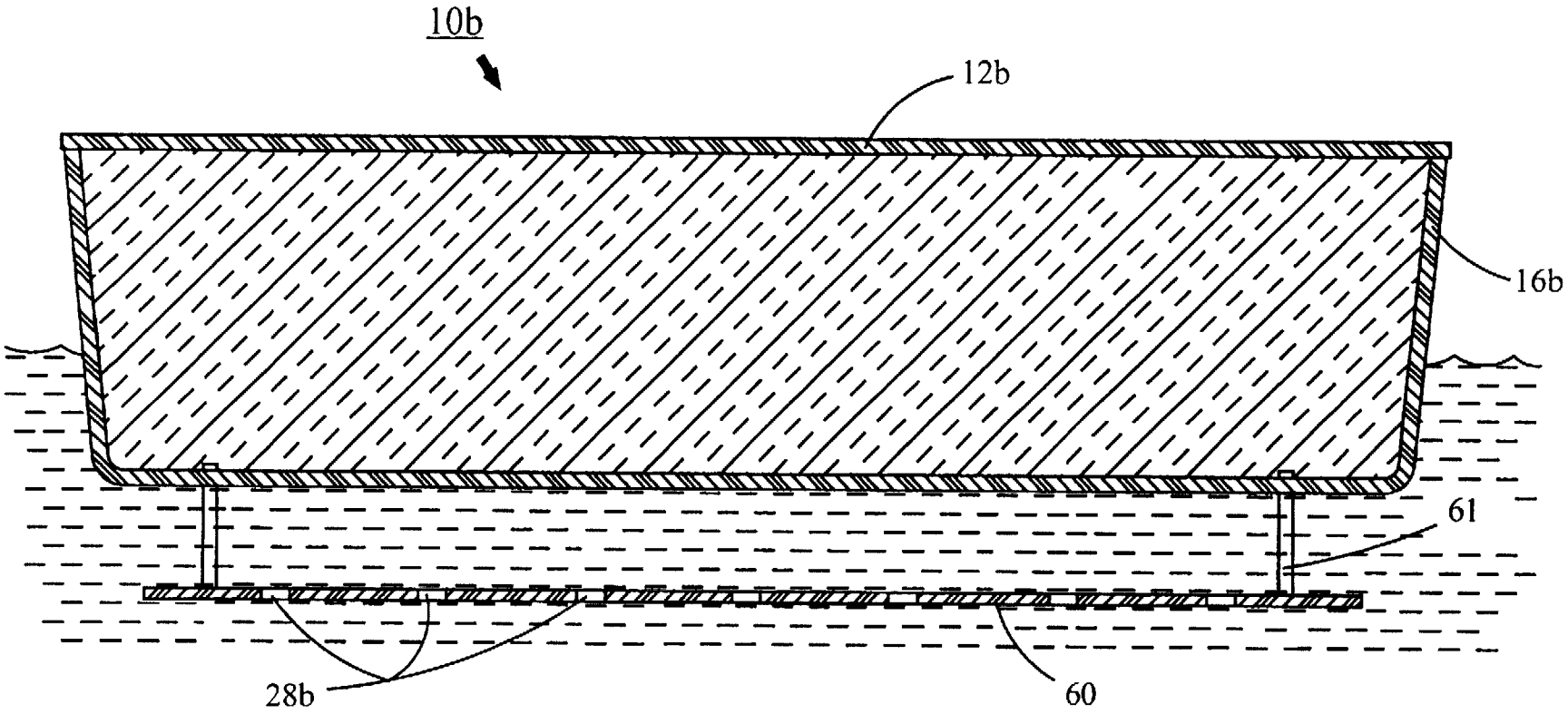
FIG. 5 is a cross sectional view of another embodiment of the present invention.

FIG. 5 shows another embodiment in which stabilization baffles 60 are hung from the foam filled float drum 10*b* on struts 61. Baffles 60 may have holes 28*b* in the bottom thereof to permit water flow therethrough as the drum 10*b* is placed in a body of water. It has been found that for certain applications baffles 60 will offer a similar resistance to displacement of the drum 10*b* as the compartment 26 does for the drum 10. It is believed that baffles 60 offer more of a frictional resistance to abrupt movement of the float drum 10*b* and are preferred for certain applications. The holes 28*b* ease initial installation.

Figure 6:
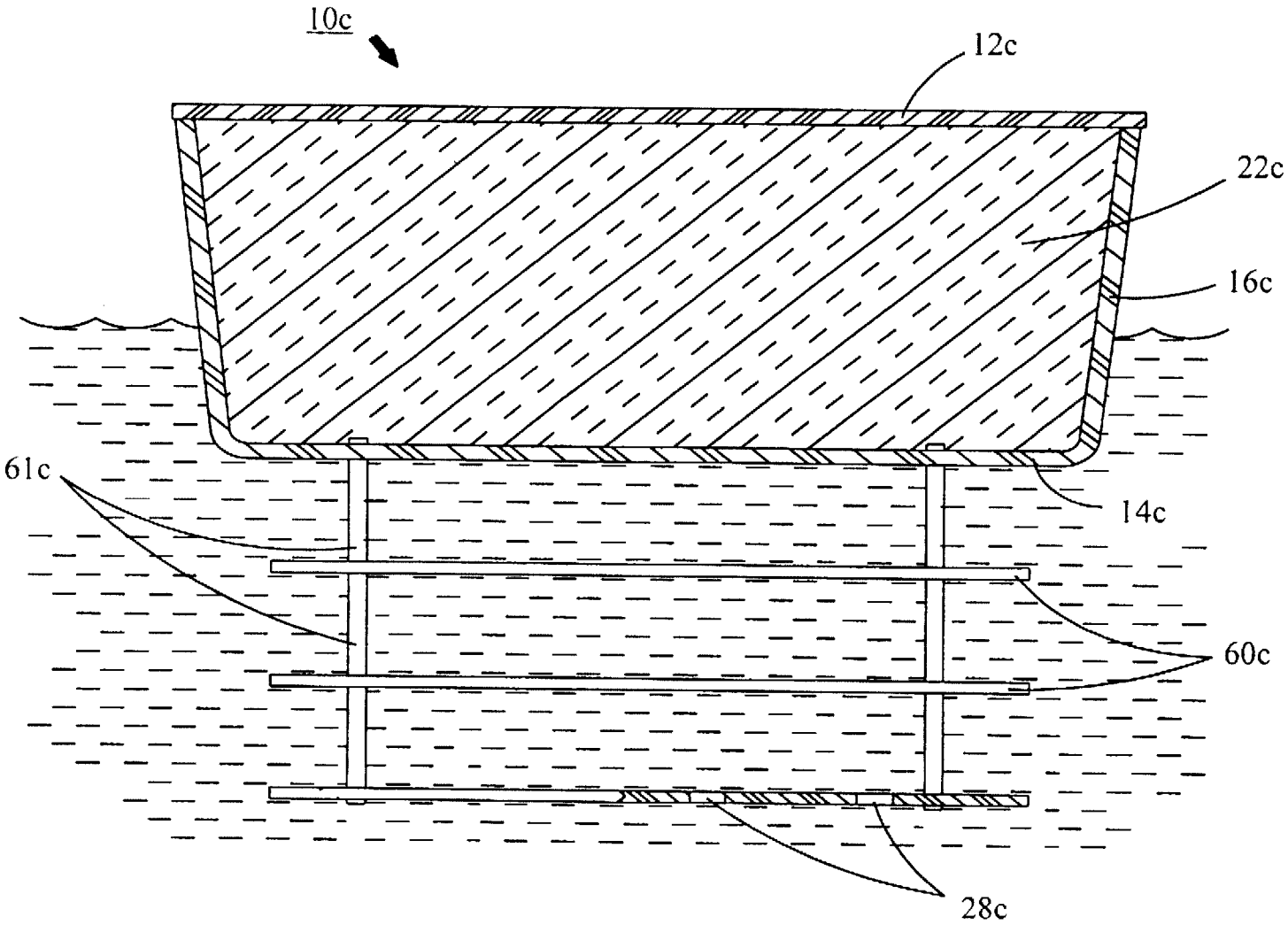
FIG. 6 is a cross sectional view of a still further embodiment of the present invention.

In FIG. 6 a series of baffles 60*c* are mounted below float drum 10*c*. The three baffles 60*c* shown provide additional resistance to abrupt movement of drum 10*c* vertically when positioned in the water. The spacing of the baffles may be adjusted to counteract specific conditions to be encountered.

The foregoing embodiments have been shown and described as made from various plastics. Floats, especially barrels and larger ones have been made from steel, aluminum, stainless steel etc. for many years. Obviously where advantageous the float drums of the present invention could be made of the same materials.

The configurations shown in FIGS. 1 & 5 are preferred construction for buoyant float drums to be used to counteract eccentric loads in a dock structure. Where the primary objective is to damp wave or wind action the FIG. 1 construction with lower compartment 22 made much deeper relative to the upper compartment 20 would be used. Instead of the upper compartment comprising two thirds of the total it might be only one fifth of the total. A dock constructed with such float drums could function almost as a breakwater for instance.

Referring now to FIG. 7 there is shown an elongated floating dock structure utilizing float drums according to the present invention to stabilize the dock structure. As shown dock 70 has two central rows 72 of conventional closed cell filled float drums 71 secured along either side of the centerline. A number of buoyant float drums 10 made in accordance with FIG. 1 are placed along the outside of rows 72 to form rows 74 along the edges of elongated dock 70. Periodically along the length of dock 70, usually at the ends of each module, several float drums 10 are placed transversely of the rows 72 and 74. Float drums 10 with their compartments 26 stabilize the dock structure and resist tipping of the dock both laterally and longitudinally. A heavy load, such as several people in a group, on one edge of dock 70 will tend to lift the float drums 10 along the opposite edge but the water 26 in the compartments 22 of the drums 10 will resist the elevation of the opposite edge and thus act to stabilize the dock structure against tipping. This damping of lateral motion is accomplished by float drums 10 without the penalty of any needed additional flotation as would be required by solid weights for instance. The particular amount of tipping resistance is a function of the size of the compartments and the number and size of the holes 28 in each float drum.

Floats 10 unless needed for flotation need not be placed continuously along each edge but may be spaced apart so as to give the desired stabilization. Each individual float drum 10 will be self stabilizing in a similar manner to the above. In addition a cumulative stabilizing effect is obtained in a multiple drum dock structure as shown in FIG. 7.

Baffles attached to the float drums as shown in FIGS. 5 & 6 will for certain applications perform in a similar fashion to stabilize a dock structure. Again the baffle spacing, and the size, shape and number of holes, if any, in the baffles are selected for the conditions expected to be encountered.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

I claim:

1. A buoyant float drum for providing floatation of structures in a fluid which comprises:

a hollow polygonal outer body portion having top, bottom and side wall members;

an interior wall member mounted within said hollow body portion to form said body into first and second compartments;

a flotation medium sealed within said first compartment; and a plurality of fluid vent holes formed in the bottom and sides of said second compartment;

whereby when said float drum is placed in a body of fluid said first compartment will cause said drum to float in said body of fluid and said second compartment will fill with fluid to stabilize said float drum.

2. A float drum as claimed in claim 1 wherein said floatation medium is a closed cell EPS foam material.

3. A float drum as claimed in claim 1 wherein said flotation medium is air.

4. A float drum as claimed in claim 1 further including a plurality of male and female flange and recess members disposed about the circumference of said top member adapted for interlocking mating with corresponding flanges and recesses in similar adjacent float drums.

5. A float drum as claimed in claim 1 wherein said first compartment comprises over one-half of the volume of said hollow outer body portion.

6. A float drum as claimed in claim 5 wherein said hollow outer body portion is a rectangular box approximately forty-eight inches long by twenty-four inches wide by sixteen inches deep with said first compartment having a depth of twelve inches and being filled with closed cell EPS foam.

7. A float drum as claimed in claim 5 wherein said first compartment comprises two-thirds of the volume of said hollow outer body portion.

8. A float drum as claimed in claim 1 wherein said first compartment comprises less than one-quarter of the volume of said hollow outer body portion.

9. A float drum as claimed in claim 2 wherein said outer body portion and interior wall member are formed from a moldable plastic material essentially impervious to the fluid in which the drum is to be floated.

10. A float drum as claimed in claim 1 wherein said interior wall member forms a divider separating said outer body portion into a first upper compartment and a second lower compartment with said flotation medium being placed in said upper compartment.

11. A float drum as claimed in claim 1 wherein said first compartment is a smaller box formed within said outer hollow body portion and suspended from said outer body top.

12. A stabilized buoyant float drum for providing flotation for dock structures and other(of) structures in a fluid comprising in combination:

a first hollow polygonal body portion having top, bottom and side wall members and a floatation medium sealed therein;

at least one second body portion;

said second body portion having at least one planar wall member spaced a preselected distance below said first body portion;

a plurality of holes formed in the surface of said second body portion to permit fluid flow therethrough;

said at least one second body portion being (operatively connected) joined to a wall member of said first body portion;

whereby when said float drum is used as flotation for a dock structure and is placed in a body of fluid said first body portion will cause said drum to float in said body of fluid and said second body portion will function as a stabilizer for said buoyant float drum and dock structure.

13. A buoyant float drum according to claim 12 wherein said second body portion is spaced below and joined to said first body portion by a strut of predetermined length.

14. A buoyant float drum according to claim 12 wherein said at least one second body portion is a flat plate.

15. A buoyant float drum according to claim 12 wherein said at least one second body portion is a flat baffle plate substantially parallel to the bottom of said first body portion and coextensive in area therewith.

16. A buoyant float drum according to claim 12 wherein said at least one second body portion comprises a plurality of parallel flat baffle plates secured below the bottom of said first body portion.

17. A buoyant float drum according to claim 16 wherein said second body portion comprises a pair of spaced apart flat plates.

18. A buoyant float drum according to claim 16 wherein said second body portion comprises three spaced apart flat plates.

* * * * *